United States Patent [19]

Brockhaus

[11] Patent Number: 4,528,718

[45] Date of Patent: Jul. 16, 1985

[54] DOOR HINGE ASSEMBLY HAVING SPLINED AND UNSPLINED HINGE PIN SECTIONS

[75] Inventor: Ernst Brockhaus, Remscheid-Hasten, Fed. Rep. of Germany

[73] Assignee: ED. Scharwächter GmbH & Co. KG, Remscheid, Fed. Rep. of Germany

[21] Appl. No.: 534,081

[22] Filed: Sep. 20, 1983

[30] Foreign Application Priority Data

Sep. 29, 1982 [DE] Fed. Rep. of Germany ..... 3236087

[51] Int. Cl.[3] ..... E05D 7/10; E05D 5/10

[52] U.S. Cl. ..... 16/266; 16/273; 16/342; 16/380; 16/386

[58] Field of Search ..... 16/265, 266, 273, 342, 16/374, 380, 381, 386, 388, DIG. 40

[56] References Cited

U.S. PATENT DOCUMENTS

| | | | |
|---|---|---|---|
| 230,491 | 7/1880 | Peer | 16/266 |
| 580,448 | 4/1897 | Buchanan | 16/266 |
| 595,789 | 12/1897 | Smith | 16/342 X |
| 1,132,601 | 3/1915 | Moynihan | 16/266 |
| 3,015,126 | 1/1962 | Algren | 16/386 |
| 3,209,391 | 10/1965 | Mangini | 16/386 X |
| 3,448,486 | 6/1969 | Wright | 16/386 X |

FOREIGN PATENT DOCUMENTS

| | | | |
|---|---|---|---|
| 1459104 | 11/1968 | Fed. Rep. of Germany | 16/386 |
| 1340951 | 9/1963 | France | 16/386 |

*Primary Examiner*—Fred Silverberg

*Attorney, Agent, or Firm*—Toren, McGeady, Stanger, Goldberg & Kiel

[57] ABSTRACT

A door hinge assembly which facilitates fitting and aligning of a door particularly in motor vehicles including a first and a second hinge member each having, respectively, a first and a second eye with a hinge pin being engaged within the eyes of the hinge members to operatively mount the hinge members together. The hinge pin is mounted so as to be freely rotatable relative to the first eye but secured against axial movement relative thereto. The hinge pin and the second eye are formed with axially extending splines engaged therebetween, the splines forming an addendum circle diameter. Axially adjacent the splines, the hinge pin is formed with a cylindrical section which engages within a complementary cylindrical recess in the second eye, the cylindrical section having a diameter which is slightly greater than the addendum circle diameter of the splines.

9 Claims, 5 Drawing Figures

FIG. 4
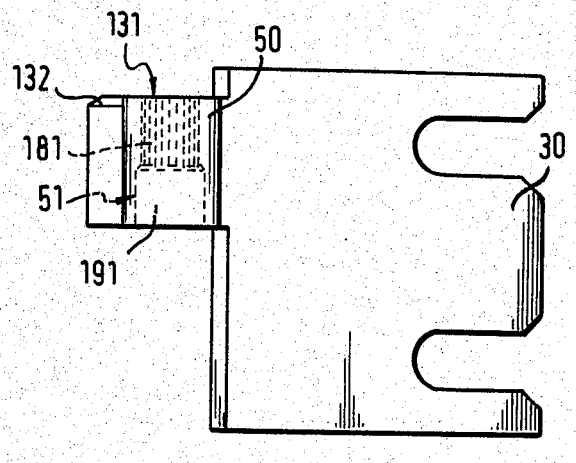
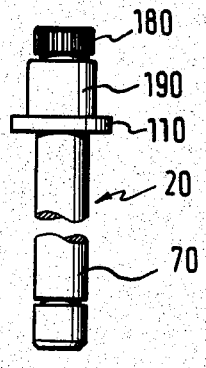
FIG. 3
FIG. 5
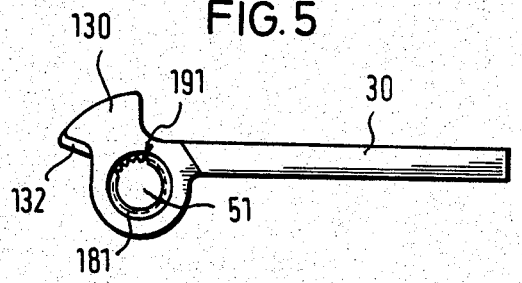

DOOR HINGE ASSEMBLY HAVING SPLINED AND UNSPLINED HINGE PIN SECTIONS

The present invention relates generally to door hinge assemblies and particularly to assemblies which are especially suitable for use in mounting doors on motor vehicles.

Door hinges of this type which unable unhingeing of the assembly during door mounting are employed in modern production facilities for automobiles in order to enable appropriate fitting and adjustment of unfinished doors in the body of the automobile and then to enable them to be removed from the body during assembly and outfitting of the automobile.

This achievement is made possible in that, on the one hand, both halves of the door hinge on the respective door part or post are attached and securely fastened in position so that when the door is again inserted or mounted on the automobile body, the door will be fitted in exact alignment with the door opening formed in the body of the vehicle. Furthermore, an advantage is achieved in that the assembly and outfitting of the automobile may be performed substantially faster and with greater ease when the doors are removed.

In modern vehicle manufacture, wherein the vehicle bodies have a contour which is shaped to provide advantageous air flow characteristics, difficulties may arise in that when the doors are to be again installed upon the vehicle body, they must be hung or hinged under conditions which are extremely cramped from the point of view of available space inasmuch as the shape of the outer contour of the vehicle body allows only very slight movement of the vehicle door in the vertical direction. Otherwise, there would occur the danger of damaging the surface finish of the body and of the door.

Moreover, motor vehicle door hinges are, on the one hand, mass-produced parts which must be manufactured with the least possible expenditure. On the other hand, however, they must withstand high loads and be maintenance-free over long operating periods while operating quietly and smoothly.

These requirements may be satisfactorily fulfilled in part by means of maintenance-free support for the hinge pin and in part by means of high precision in the production, particularly of the hinge pin and the hinge eyes. However, maintenance of high-precision in production facilities with simultaneous low production costs presupposes that there may be accomplished simultaneously certain construction characteristics while also maintaining high precision. Moreover, particularly in multi-door vehicles, the hinges assigned to individual vehicle doors often have different operating swivel angle areas which, when considering the extremely cramped spatial conditions under which the doors must be mounted or hung on the body, will greatly impede uniformity and low cost in the construction of the door hinges.

Accordingly, the present invention is directed toward providing an improved door hinge assembly for motor vehicle doors which will enable easy unhingeing and subsequent hanging of the door in a relatively simple structure which is also less expensive from the point of view of its production and which will enable the employment of uniform hinge sections for hinges with different operating swivel angle areas even under extremely cramped assembly conditions.

The present invention involves an improvement in door hinges which relates to the type of structure described and claimed in prior U.S. patent application Ser. No. 418,373, filed Dec. 15, 1982.

SUMMARY OF THE INVENTION

Briefly, the present invention may be described as a door hinge assembly particularly for motor vehicle doors comprising: a first hinge member having a first hinge eye; a second hinge member having a second hinge eye; a hinge pin engaged within said eyes of said first and said second hinge members, said hinge pin being mounted to be freely rotatable relative to said first eye and secured against axial movement relative thereto; recess means on one of said hinge members and projection means on the other of said hinge members, said recess means and said projection means cooperating with each other over a predetermined range of angular movement between said hinge members to prevent said hinge members from becoming disengaged from said hinge pin by relative movement therebetween in the axial direction; and engagement means interposed between said hinge pin and said second eye to maintain said hinge pin and said second eye in nonrotative relative engagement with each other, said engagement means comprising axially extending spline means interposed between said hinge pin and said second eye, said spline means defining an addendum circle diameter, a longitudinally extending cylindrical section located axially adjacent said spline means, and a complementary cylindrical bore defined in said second eye adapted to have said cylindrical section engaged therein, said cylindrical section on said hinge pin having a diameter which is slightly larger than said addendum circle diameter of said spline means.

In accordance with a more specific embodiment of the invention, the diameter of said cylindrical section is fractionally larger than the addendum circle diameter, specifically by a factor of 1/10.

In accordance with the present invention, the structure facilitates mounting of the hinge assembly in that as the second hinge eye is mounted on the hinge pin, the complementary cylindrical bore in the second eye first extends over the spline means and then comes to engage the longitudinally extending cylindrical section on the pin whereby the spline means may be brought into interfitting engagement. This is facilitated by virtue of the fact that the diameter of the cylindrical section on the hinge pin is larger than the addendum circle diameter of the circumferential teeth forming the spline means. The bore hole in the hinge eye in the second hinge member is constructed as a countersection and, accordingly, the complementary cylindrical bore is a smooth bore hole having a circumferential surface which is located adjacent or below the spline means formed in the second hinge eye. The dedendum circle diameter corresponding to the circumferentially stepped portion of the hinge pin is reduced. The lower part of the hinge eye bore hole of the second hinge member, which lower part has a greater inner diameter, therefore forms a running-in or assembly guide for the circumferentially toothed upper portion of the hinge pin when the hinge is to be assembled or hung, and as a result of the guide function, the hinge pin may be brought into meshing engagement with the circumferential teeth of the spline means which are formed in a bore hole in the second eye.

The section of the hinge eye bore hole in the second hinge member, which is assigned to the cylindrical longitudinal section of the hinge pin, is adapted to as to be free of play to the cylindrical longitudinal section of the hinge pin in a correctly fitting manner so that angular movements between the hinge pin and the second hinge member are prevented. It is advisable that the length of the longitudinal cylindrical section of the hinge pin be greater than the length of its circumferential toothing and that it amount to a multiple thereof.

In the interests of minimizing costs and enabling the door hinges to be formed as mass-produced parts, particularly door hinges having different operating swivel angles, uniform hinge sections are employed for producing the two hinge members and in particular it is provided in accordance with a characterizing feature of the invention that a radially directed projection formed in the second hinge member be assigned to engage in a recess in the first hinge member, the recess being directed parallel to the hinge pin with the curvature of the projection having an arc length which is concentric relative to the hinge pin and which overlaps the entire maximum allowable operating angle of the door hinge. Radial projection of the first hinge member is preferably formed by means of a web arrangement of the corresponding hinge section, which web arrangement is formed in one piece with the first hinge member.

The radially directed projection formed on the second hinge member preferably extends further over the entire height of the hinge eye of the first hinge member and it may be provided with a sloped or beveled upper surface which facilitates movement of the projection within the recess of the first hinge member.

In the production and installation of door hinge assemblies in accordance with the present invention having different operating swivel angles from uniform hinge sections, a particular advantage arises in that the arc length of the radially directed projection on the second hinge member is made to correspond with a single, common unhingeing and opening angle when there are different allowable operating opening angles.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DESCRIPTION OF THE DRAWINGS

In the drawings:

FIG. 3 is a side view showing the hinge pin separate from the overall assembly;

FIG. 4 is a side view showing the second hinge member separately from the assembly; and FIG. 5 is a top view of the hinge member shown in FIG. 4.

DETAILED DESCRIPTION OF THE PREFERRED EMBODIMENT

Figure 1:
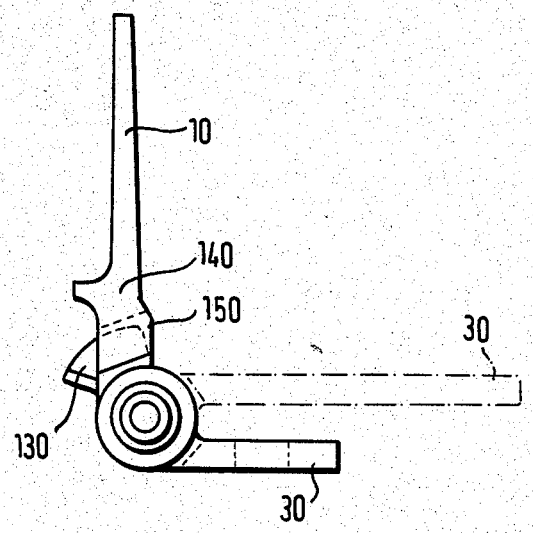
FIG. 1 is a top view of a hinge assembly in accordance with the invention.
Figure 2:
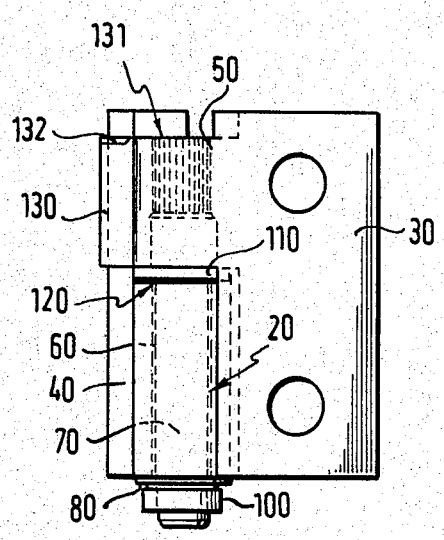
FIG. 2 is a side view of the assembly.

Referring now to the drawings, there is shown a hinge assembly which constitutes a preferred embodiment of the invention and which comprises a first hinge member 10 which may be fastened at one side of a door mount structure (not shown) and a second hinge member 30 which is pivotally connected with the first hinge member 10 by means of a hinge pin 20, the hinge pin extending through a hinge eye 40 formed in the hinge member 10 and a hinge eye 50 formed in the second hinge member 30.

The hinge pin 20 is rotatably supported at a cylindrical section 70 thereof in the hinge eye 40 by means of a bush 60 of bearing material and is secured against displacement in the axial direction by means of a securing device 100 supported at a lower outer surface 80 of the hinge member 10.

In the reverse direction, the hinge pin 20 is likewise secured against displacement in the axial direction by means of a radially directed disc 110 which is supported on a front face 120 of the hinge eye 40. The two hinge members 10 and 30 are secured against axial displacement relative to one another over the maximum operating angular displacement of the hinge assembly by means of a projection 130 which engages in a recess 150 formed in the hinge blade 140 of the first hinge member 10 and connected at the hinge eye 50 of the second hinge member 30.

The projection 130 is formed with an arcuate shape which is concentric with the axis of the hinge pin 20 and it has an arc length which corresponds to the entire maximum allowable operating angle of the door hinge. Furthermore, the projection 130 is formed by processing a section web of the hinge section, which section web is connected at the hinge eye 50 of the second hinge member 30, and the projection 130 extends substantially over the entire height of the hinge eye 50.

The projection 130 is provided with a sloped face 132 arranged at the front of its upper surface 131, with the sloped face 132 facilitating the running-in of the recess 150 into the hinge wing blade 140 of the hinge member 10 when the door hinge is to be hung or assembled. As will be seen particularly from FIG. 1, a uniform arc length of the projection 130 of the second hinge member 30, and in connection therewith a uniform unhingeing opening angle, is assigned to different operating opening angle areas of the door hinge assembly.

In the upper area of the hinge pin 20, which upper area projects in the axial direction over the hinge eye 40 of the first hinge member 10 and the radially projecting disc 110, a circumferential toothing or spline means 180 and a cylindrical section 190 are constructed sequentially or adjacent to each other taken from the top to the botton of the hinge pin 20. In the assembly shown, the pin 20 is formed with axially extending splines and the second hinge eye 50 is formed with axially extending recesses within which the splines engage. Thus, the hinge pin 20 and the second hinge member 30 are held in nonrotatable engagement relative to each other.

The hinge pin 20 is formed with the cylindrical section 190 which is located immediately adjacent the splines 180, and the second eye of the hinge member 30 is formed with a lower bore 191 within which the section 190 may engage.

The spline means 180 are formed with an addendum circle diameter and the diameter of the cylindrical longitudinal section 190 of the hinge pin 20 is formed to be slightly greater than the addendum circle diameter of the spline means 180. In accordance with a specific embodiment of the invention, the diameter of the section 190 is larger by a factor of 1/10 of the addendum circle diameter of the circumferential toothing 180.

Moreover, the axial length of the cylindrical section 190 is dimensioned so as to be greater than the axial length of the spline means 180.

The second hinge eye 50 is formed with a hinge eye bore hole 51 which is constructed so as to be adapted to engage with the hinge pin construction. The bore hole 51 therefore comprises the lower cylindrical bore hole section 191 which is formed with a smooth cylindrical circumferential wall which is adapted to be complementary to the cylindrical longitudinal section 190 of the hinge pin 20 to engage therewith in a play-free firm fit. In its upper area, the bore hole 51 comprises a section 181 provided with the inner circumferential teeth which correspond to the outer circumferential teeth 180 which together form the spline means operatively interposed between the hinge pin 20 and the second eye 50. The diameter of the splines 181 is smaller than the diameter of the bore hole section 191 by a slight amount which may be preferably 1/10 of the addendum circle diameter of the splines 180.

When the second hinge member 30 is to be hung on the hinge pin 20, the smooth-faced section 191 of the bore hole 51 operates as a guide element, with reference to the splines 180 of the hinge pin, which facilitates meshing of the splines 180 of the hinge pin 20 within the inner circumferential splines 181 of the bore hole 51. At the same time, there is ensured mutual alignment of the outer circumferential splines 180 of the hinge pin 20 relative to the inner circumferential splines 181 of the bore hole 51, particularly as a consequence of the slightly enlarged diameter.

Moreover, a fit which is free of play is accomplished due to the construction of the hinge pin section 190, on the one hand, and the smooth bore hole section 191 of the bore hole 51 of the hinge eye 40 on the other hand. This ensures smooth opening and closing movement of the vehicle door without rattles and without unwanted play.

While a specific embodiment of the invention has been shown and described in detail to illustrate the application of the inventive principles, it will be understood that the invention may be embodied otherwise without departing from such principles.

What is claimed is:

1. A door hinge assembly particularly for motor vehicle doors comprising: a first hinge member having a first hinge eye; a second hinge member having a second hinge eye; a hinge pin defining an axial direction engaged within said first and second hinge eyes, said hinge pin being mounted to be freely rotatable relative to said first eye and secured against axial movement relative thereto; recess means on one of said hinge members and projection means on the other of said hinge members, said recess means and said projection means cooperating with each other over a predetermined range of angular movement between said hinge members to prevent said hinge members from becoming disengaged from said hinge pin by relative movement therebetween in the axial direction of said pin; and engagement means interposed between said hinge pin and said second eye to maintain said hinge pin and said second eye in nonrotative relative engagement with each other, said engagement means comprising axially extending spline means interposed between said hinge pin and said second eye, said spline means defining an addendum circle diamater, a longitudinally extending cylindrical section located axially adjacent said spline means on said hinge pin and a complementary cylindrical bore defined in said second eye adapted to have said cylindrical section engaged therein, said cylindrical section on said hinge pin having a diameter which is slightly larger than said addendum circle diameter of said spline means.

2. A hinge assembly according to claim 1 wherein said cylindrical section on said hinge pin has a diameter which is greater than said addendum circle diameter by an amount equal to about 1/10 of said addendum circle diameter.

3. A hinge assembly according to claim 1 wherein said complementary cylindrical bore and said longitudinally extending cylindrical section are dimensioned to be engaged with a relatively tight fit free of play therebetween.

4. A hinge assembly according to claim 1 wherein said longitudinally extending cylindrical section extends in said axial direction a greater distance than said spline means.

5. A hinge assembly according to claim 4 wherein said longitudinally extending cylindrical section is greater in axial length than said spline means by a multiple of the length of said spline means.

6. A hinge assembly according to claim 1 defining a maximum permissible operating angular displacement between said first and said second hinge members wherein said projection means comprise a radially extending projection on said second hinge member and wherein said recess means comprise a recess formed in said first hinge member, said recess being directed parallel to said hinge pin, said projection having an arcuate configuration with an arc length concentric with said hinge pin and extending over said maximum permissible operating angular displacement between said first and said second hinge members.

7. A hinge assembly according to claim 6 wherein said radially extending projection extends axially over the entire length of said second hinge eye measured along said axial direction.

8. A hinge assembly according to claim 7 wherein said radially extending projection is provided with a sloped face to facilitate engagement thereof within said recess.

9. A hinge assembly according to claim 6 wherein said radially extending projection is constructed integrally with said second hinge member.

* * * * *